United States Patent [19]

Imhof et al.

[11] Patent Number: 5,000,833

[45] Date of Patent: Mar. 19, 1991

[54] APPARATUS FOR THE ELECTROCHEMICAL SURFACE TREATMENT OF SUBSTRATES

[75] Inventors: Otwin Imhof, Nürtingen; Holger Kistrup, Esslingen; Claus Schneider, Fellbach, all of Fed. Rep. of Germany

[73] Assignee: Deutsche Automobilgesellschaft MbH, Fed. Rep. of Germany

[21] Appl. No.: 414,245

[22] Filed: Sep. 29, 1989

[30] Foreign Application Priority Data

Nov. 26, 1988 [DE] Fed. Rep. of Germany ..... 3839972

[51] Int. Cl.[5] ..... C25D 17/08

[52] U.S. Cl. ..... 204/297 W

[58] Field of Search ..... 204/297 W

[56] References Cited

U.S. PATENT DOCUMENTS

| | | | |
|---|---|---|---|
| 1,010,647 | 12/1911 | Leffel | 204/297 W |
| 1,521,592 | 1/1925 | Belke | 204/297 W |
| 2,072,170 | 3/1937 | Herzog | 204/297 |
| 3,923,631 | 12/1975 | Palisin, Jr. | 204/297 W |
| 3,939,056 | 2/1976 | Fueki et al. | 204/297 W |

FOREIGN PATENT DOCUMENTS

| | | |
|---|---|---|
| 3111786 | 10/1982 | Fed. Rep. of Germany . |
| 3246774 | 6/1984 | Fed. Rep. of Germany . |
| 70029084 | 9/1970 | Japan . |

OTHER PUBLICATIONS

W. Dettner, V. J. Elze, "Handbuch de Galvanotechnik", Bano I., Teil 1, Suite 512 FF.

*Primary Examiner*—T. M. Tufariello

*Attorney, Agent, or Firm*—Evenson, Wands, Edwards, Lenahan & McKeown

[57] ABSTRACT

An electroplating rack for the electrochemical surface treatment of metallic substrates or metallized plastic substrates is described. The metallic rack is, moreover, covered with an insulating layer of enamel, contact points being left bare at which the substrate to be treated is connected in an electrically conducting manner to the rack during the electroplating process.

3 Claims, 2 Drawing Sheets

APPARATUS FOR THE ELECTROCHEMICAL SURFACE TREATMENT OF SUBSTRATES

BACKGROUND AND SUMMARY OF THE INVENTION

The present invention relates to an apparatus for the electrochemical surface treatment of substrates and more particularly to an electroplating rack.

The treatment of a wide variety of substrates by electroplating is generally known. This technique of depositing individual metals or even metal alloys on the surface of substrates is primarily used if the layer to be electrodeposited is intended to impart to the treated substrate certain properties which the substrate does not itself have or does not adequately have, such as, for example, electrical conductivity, luster, reflecting power, chemical resistance, etc.

Since individual metals or alloys may also be deposited successively on the surface of the substrate, it is possible to impart desired properties to the substrate in a very controlled manner; for example to achieve an appropriate corrosion resistance for the substrate.

Initially only substrates which had metallic properties themselves were subjected to the technique of surface treatment by electroplating. In the case of these substrates, it was possible to carry out the metallic deposition on the surface by electroplating apparatus directly and without difficulty by applying an electric field, the substrate simply being connected as cathode in the process.

After an ever increasing number of plastic fiber substrates were used in practice for a wide variety of applications, a surface treatment by electroplating also became standard in the case of these substrates. For this purpose, the electrically nonconducting plastic surfaces are first activated by depositing a catalytically active substance and then metallized by mechanical means. The electrically nonconducting plastic surfaces are therefore provided with a metallic coating which is subsequently reinforced by electroplating in a suitable manner with the same metal and/or even another metal.

The application of the above-mentioned technology to textile fabrics, non-woven materials, needle-bonded felts or open-pore foams opened up completely new fields of application for these materials. Starting from the materials mentioned, it has become possible, as a result of the preceding chemical deposition and subsequent electrodeposition of metal on the plastic surface, to combine the highly porous properties of these plastic products in an advantageous manner with metallic properties such as, for example, magnetism, screening capacity or electrical conductivity.

The surface treatment of metallized substrates by electroplating is in general carried out in a manner such that the substrate to be electroplated is mounted on an electroplating rack. The substrate has to be adequately electrically connected to the electroplating rack under these circumstances. This is done, for example, by suspending, clipping and/or clamping the substrate on the electroplating rack which is provided with an insulating plastic layer over its entire surface except at the contact points with the substrate. The electroplating rack supporting the substrates is introduced into the electroplating bath and the process of electroplating is carried out.

The electroplating racks used are generallY composed of an iron containing material, for example of a stainless steel. Firmly adhering plastics, for example polyvinyl chloride or polyethylene, in the form of a continuous layer or in the form of a plastic adhesive tape are used as an insulating layer. Layers of rubber or of wax are also known as insulating materials (W. Dettner and J. Elze "Handbuch der Galvanotechnik" ("Manual of Electroplating" (1963), Volume I, Part 1, pages 514 ff).

When such electroplating racks which are covered (except at the contact points with the substrate) are used, it has repeatedly been found that dendrite-like structures of the metal deposited during electroplating are formed while the electroplating process is being carried out and even grow through the insulation of the electroplating rack. The formation of these dendrites on the metallic parts of the rack can be explained by the fact that the plastic layer deposited on the rack has fine pores from the outset.

Alternatively, microcracks or microholes are produced in the plastic layer as a result of use of the rack (for example, due to sharp edges in the rack), with the result that the electroplating solution is able to penetrate to the metallic parts of the rack. The high current density in the electroplating bath and an inadequate electrical conductivity of the substrate to be electroplated occurs at the start of the electroplating process, particularly in the case of the treatment of premetallized plastic surfaces. Removal of the metal dendrites which have grown through the plastic insulation is very time-consuming and, in addition, associated with high cost. Renewal of the plastic insulation at the damaged points can also be carried out only with a high cost expenditure.

An object of the present invention is therefore to provide an apparatus for the electrochemical surface treatment of metallic substrates or metallized plastic substrates, in which the metallic rack has an impermeable and resistant insulating layer and consequently the above-cited adverse phenomena of the formation of dendrite-like structures on the metallic parent body are no longer able to occur during the electroplating process and consequently the electroplating rack remains serviceable for a longer service life.

This object and other objects are achieved, according to one embodiment of the present invention, in that an enamel layer is deposited on the metallic rack as an insulating layer.

Other objects, advantages and novel features of the present invention will become apparent from the following detailed description of the invention when considered in conjunction with the accompanying drawings.

DETAILED DESCRIPTION OF THE DRAWINGS

Figure 1:
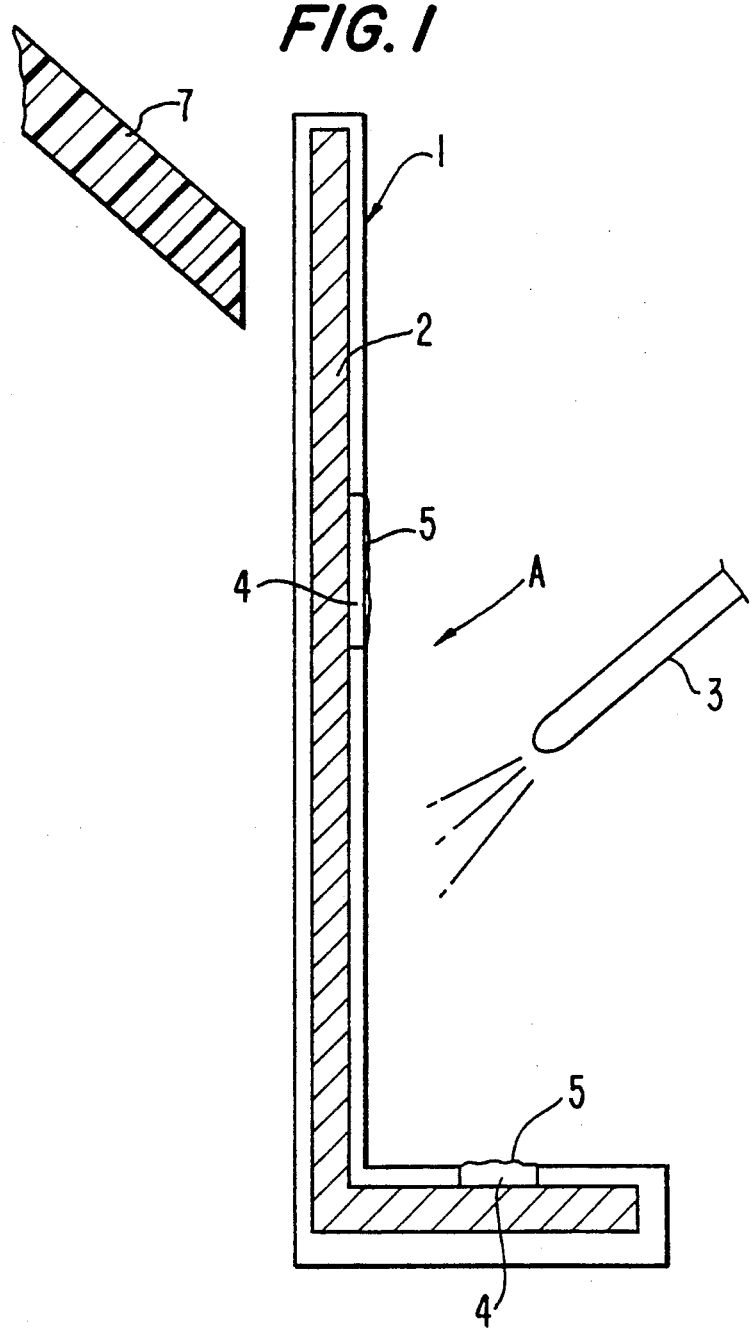
FIG. 1 illustrates a method of forming an electrochemical rack in accordance with one embodiment of the present invention.
Figure 2:
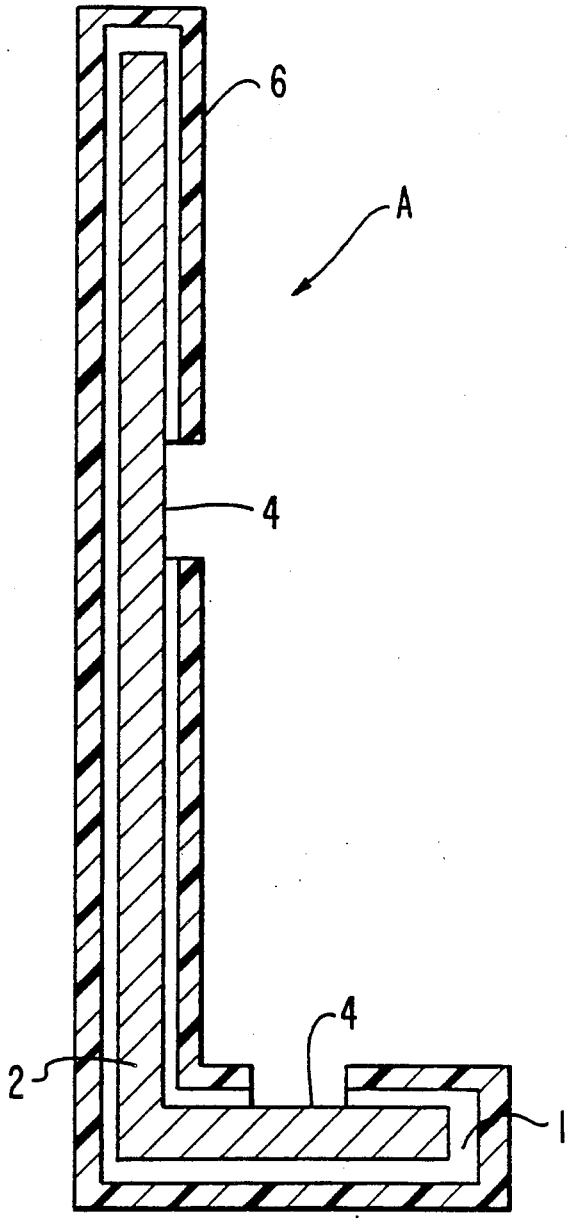
FIG. 2 illustrates a further embodiment of the electrochemical rack of the present invention.

The deposition of an enamel layer 1 on a metallic rack A, made of, for example, iron, or an iron containing metal 2, is carried out as shown in FIG. 1, in a known manner by applying the enamel layer 1, for example with a spray gun 3, in a thin layer to the metal parts 2 which have previously been degreased, pickled and rinsed to neutralize acid residues. In this process, the planned current conducting points 4 on the rack A are masked; this may be done, for example, with wax 5 or any other substance which can be easily removed after the enamelling of these points 4 has been carried out. The composition of the enamel layer 1 deposited on the metal parts 2 of the rack A is, moreover, matched to the electroplating electrolyte in relation to resistance to alkali solution or acid. Once the enamel layer 1 has set, in accordance with a further embodiment of the present invention, the rack A can be covered with a plastic layer 6, as seen in FIG. 2, by, for example, wrapping with an adhesive plastic tape 7.

The advantages of the invention are that the racks covered with an enamel layer have a substantially longer period of use, if treated correctly, when used for the electrochemical surface treatment of substrates. This advantage emerges clearly from the examples quoted below.

EXAMPLE 1

An electroplating rack whose parts were composed of V2A steel and which were provided with a coating of hard PVC was introduced into an electroplating bath. Mounted on the rack were felt strips of polypropylene fibers which had been chemically nickel-plated beforehand (fiber thickness 2.7 dtex, porosity 93%, length of the individual strips 666 mm, with a width of 120 mm and a thickness of 5 mm). Clipped on the rack were three felt strips which had been nickel-plated previously and which were replaced by new felt strips to be electroplated, after 2,000 Ah had passed through the nickel electroplating bath. Even after a short duration of use of the rack, the formation of dendrites could be observed. These nickel dendrites produced were regularly removed before each new loading of the rack. After a total duration of use of the electroplating rack of 8 weeks, in which a total of 240 kAh passed through the nickel electroplating bath, nickel dendrites had formed at so numerous points on the iron rack and had grown through the insulating layer and consequently destroyed the insulating layer to such an extent that it was necessary to deposit a new insulating layer on the iron rack.

EXAMPLE 2

A galvanic rack composed of V2A steel was likewise introduced into an electroplating bath of the same composition. The metal parts of this rack were covered with ah acid-resistant enamel layer (in accordance with DIN Standard 51 150), the planned contact points having previously been masked with wax. With correct careful treatment (no damage to the enamel layer due to impacts and the like) no appreciable occurrence of nickel dendrites in the region of the enamel layer could be detected in the case of this electroplating rack with a duration of use of likewise 8 weeks in a nickel electroplating bath and with the passage likewise of 240 kAh.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An apparatus for electrochemical surface treatment of at least one of metallic substrates and metallized plastic substrates comprising:

a metallic rack;

an insulating layer of enamel covering the rack, the insulating layer having bared contact points for establishing an electrical contact with a substrate to be mounted on the rack and to be treated; and a plastic layer covering the insulating layer.

2. An apparatus according to claim 1, wherein the metallic rack is made of one of iron and an iron containing material.

3. An apparatus according to claim 1, wherein the plastic layer comprises adhesive plastic tape.

* * * * *